United States Patent [19]

Kindig et al.

[11] Patent Number: 4,551,948

[45] Date of Patent: Nov. 12, 1985

[54] GLASS SHAPING MACHINE

[76] Inventors: Morris L. Kindig, 255-58 S. Rengstorff, Mountain View, Calif. 94040; Cleon V. Kindig, deceased, late of San Jose, Calif.; by Eunice L. Kindig, executrix, 1904 Serge Ave., San Jose, Calif. 95130

[21] Appl. No.: 546,403

[22] Filed: Oct. 28, 1983

[51] Int. Cl.[4] ..... B24B 9/08

[52] U.S. Cl. ..... 51/98 R; 51/102; 51/128; 51/240 GB; 51/270; 83/448; 144/286 R; 409/138; 409/225

[58] Field of Search ..... 51/98 R, 102, 128, 168, 51/170 PT, 206 R, 206 P, 240 R, 240 GB, 240 A, 241.6, 267, 270, 272, 283 E; 83/438, 440, 445, 448, 477.2; 144/286 R; 403/345, 359, 375; 409/219, 224, 225, 344, 138

[56] References Cited

U.S. PATENT DOCUMENTS

| | | | |
|---|---|---|---|
| 323,229 | 7/1885 | Strobridge et al. | 83/448 |
| 1,881,839 | 10/1932 | Monson | 51/240 A X |
| 2,000,667 | 5/1935 | Osterholm | 51/102 |
| 2,578,149 | 12/1951 | Pocci | 51/170 PT |
| 2,637,852 | 5/1953 | Globe | 51/270 X |
| 3,462,887 | 8/1969 | Hackman | 51/206 P |
| 3,880,536 | 4/1975 | Petrus | 403/375 X |
| 3,981,105 | 9/1976 | Flaherty et al. | 51/272 X |
| 4,053,288 | 10/1977 | Barron | 51/128 X |
| 4,322,915 | 4/1982 | Kindig | 51/102 X |
| 4,423,568 | 1/1984 | Gould | 51/272 X |

FOREIGN PATENT DOCUMENTS

| | | | |
|---|---|---|---|
| 2530835 | 1/1977 | Fed. Rep. of Germany | 51/168 |

*Primary Examiner*—Robert P. Olszewski
*Attorney, Agent, or Firm*—Thomas E. Schatzel

[57] ABSTRACT

A glass shaping apparatus having a housing including a work surface integrally formed to the housing top and a variable-speed drive motor mounted within the housing with a drive shaft, including a grinding surface, protruding through a penetration onto the work surface. The motor includes a manual rotatable thumbwheel for adjusting the speed of the rotating grinding surface for the type of glass being shaped. The sloping design of the work surface accelerates the escape of byproducts and provides complete support to the glass. Attachments for high-speed rotary sawing and engraving of glass at 10,000 revolutions per minute are available.

7 Claims, 7 Drawing Figures

GLASS SHAPING MACHINE

BACKGROUND OF THE INVENTION

1. Field of the Invention

This invention relates generally to glass shaping devices and more particularly to a glass shaping machine wherein the edge of a glass object such as stained or beveled glass may be finished for assembly, for scoring, breaking or sawing.

2. Description of the Prior Art

In the past, the shaping of stained glass has been accomplished by the use of a grozer-router edging machine. This machine includes a mounted motor with a diamond plated grinding head, a removable aluminum or plastic work surface and a single-speed, single-phase motor. The work surface used often formed a water reservoir that served as a cooling medium and lubricant for the grinding head. A sponge was placed behind the grinding head in a reservoir to draw and direct cooling water to the grinding head. The grinding head was comprised of brass, stainless steel or other metal and was physically connected to the shaft of the mounted motor by a setscrew. The grinding head supported a grinding ring formed by a sintered matrix process utilizing soft iron, fillers and diamonds heat fused together or by a nickel plating which acted as a binder to hold the diamonds in place.

As the glass is edged, by-products of the silica glass produced by the grinding combine with the cooling water to form a residue called slurry. After slurry sets, it tends to cause permanent seizure of the metallic grinding head to the motor shaft. This presents the problem of not being able to remove the head.

Another problem concerned the metallic and plastic work surfaces. The prior art discloses work surfaces that must be removed from the apparatus to be cleaned and in particular the metallic work surface had the potential of scratching the glass object being edged.

A major problem with the prior art edgers was that of inadequate motor speed. The basic apparatus did not offer a variable speed motor and thus the same edging speed was used for each type of glass and the speed was limited to low-to-medium revolutions per minute (RPM).

There are many devices of the prior art that include these problems. Some devices are for bevel routing, radius or perpendicular edge routing and sculpture routing which grind the edge or surface of the glass. These devices were of low to medium RPM and usually included a removable work surface made of aluminum that could scratch the glass. The bevelers and routers of the prior art did not have a multi-speed capability available in a 120 volt, single phase, 50 or 60 Hertz edition for home and shop use. There still is a need for an edger with an integral work surface which accelerates the flow of slurry, completely supports the glass being edged and does not require removal for effective cleanup. Additionally, there is also a need for a non-metallic grinding support head that will not seize to the motor shaft if the slurry hardens. Finally there is a continuing need for a very high speed device with a variable speed control to improve grinding efficiency, reduce glass chipping and be utilized for proposed sawing and/or engraving glass surfaces.

SUMMARY OF THE PRESENT INVENTION

It is therefore an object of the present invention to provide an improved glass shaping machine having manually operated control for controlling the grinding speed of the machine for varying types of glass.

It is a further object to provide an improved glass shaping machine having an integral work surface with a geometric design that accelerates the flow of slurry and promotes cleaning and maintenance of the work surface while completely supporting the glass being edged.

It is a further object to provide an improved glass shaping machine having a very high speed rotary rasp saw attachment which permits sawing flat glass on an auxiliary work surface.

It is a further object to provide an improved glass shaping machine having an adjustable, self-locking, tapered grinding support head comprised of a plastic which avoids seizure to the motor shaft when the slurry hardens.

It is a further object to provide an improved glass shaping machine having a very high speed flexible shaft rotary attachment which permits improved engraving results on glass surfaces.

Briefly, a preferred embodiment of the present invention includes a housing comprised of a top and a bottom portion which includes a work surface integrally formed to the top portion of the housing. A drive motor having variable speed capacity is mounted within the housing and a drive shaft protrudes through an offset center penetration of the top portion of the housing. A plastic grinding support head with a grinding surface permanently affixed to the support head is physically connected to the drive shaft above the integral work surface external to the housing. The electrical circuit connected to the motor within the housing also includes a manually operated controller which is comprised of a variable impedance and a full-wave rectifier. Additionally, the glass shaping machine includes attachments for a very high speed rotary rasp saw for sawing flat glass and for a very high speed flexible rotary shaft for engraving on glass surfaces.

Once the motor is energized the drive shaft, grinding support head and grinding surface all rotate. The 120 a.c. volt input is varied by manually adjusting the impedance of the controller and the input signal waveform is full-wave rectified producing a variable d.c. voltage signal. This d.c. signal energizes the drive motor which is a d.c. permanent magnet motor. As a glass object is positioned onto the integral work surface, the speed of the grinding surface may be adjusted for the type of glass being edged. The geometrical design of the integral work surface and a sloping horizontal member of the top portion thereunder accelerates the flow of slurry produced by cooling water and silica residue while providing complete support for the glass object.

An advantage of the glass shaping machine of the present invention is that the cutting speed of the machine is manually controlled to accommodate different types of glass.

Another advantage is that the glass shaping machine has an integral work surface with a geometrical design that accelerates the flow of slurry and promotes cleaning and maintenance of the work surface.

A further advantage is that the glass shaping machine has a very high speed rotary rasp saw attachment which permits sawing flat glass on an auxiliary work surface.

A further advantage is that the glass shaping machine has an adjustable, self-locking, tapered grinding support head comprised of a plastic which avoids seizure to the motor shaft when the slurry hardens.

A further advantage is that the glass shaping machine has a very high speed flexible shaft rotary attachment which permits improved engraving results on glass surfaces.

These and other objects and advantages of the present invention will no doubt become obvious to those of ordinary skill in the art after having read the following detailed description of the preferred embodiments which are illustrated in the various drawing figures.

IN THE DRAWING

DETAILED DESCRIPTION OF THE PREFERRED EMBODIMENT

Figure 1:
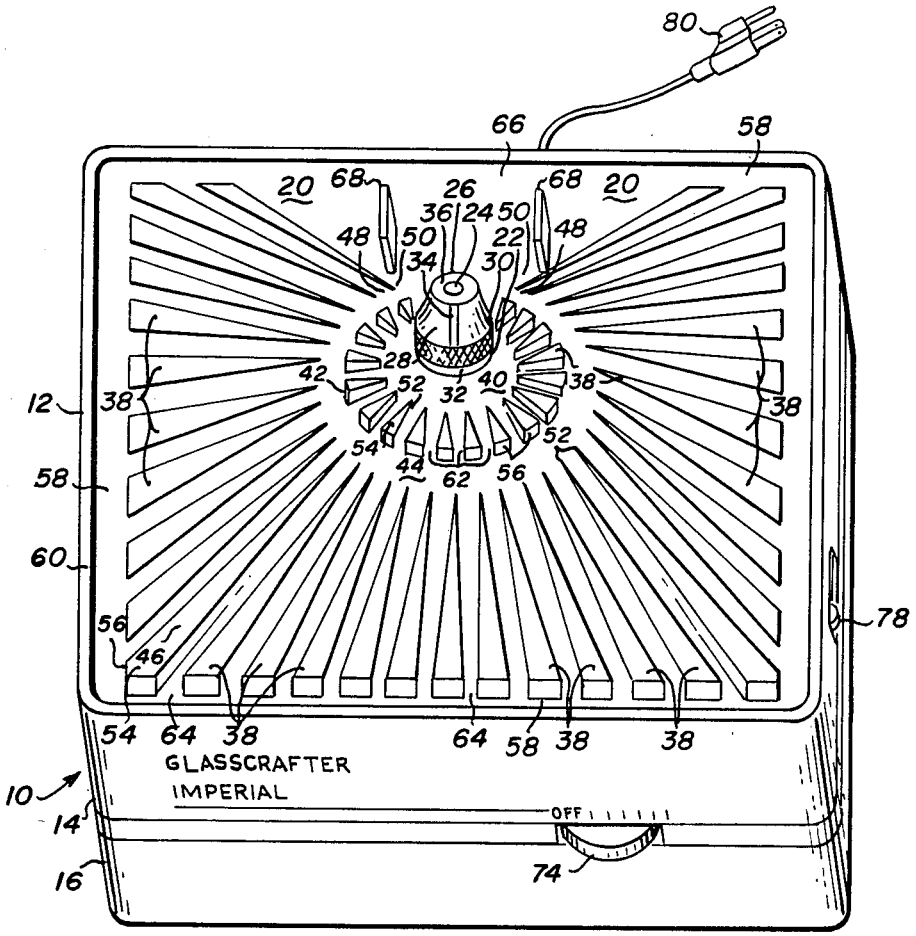
FIG. 1 is a perspective view of a glass shaping machine in accordance ith the present invention.
Figure 2:
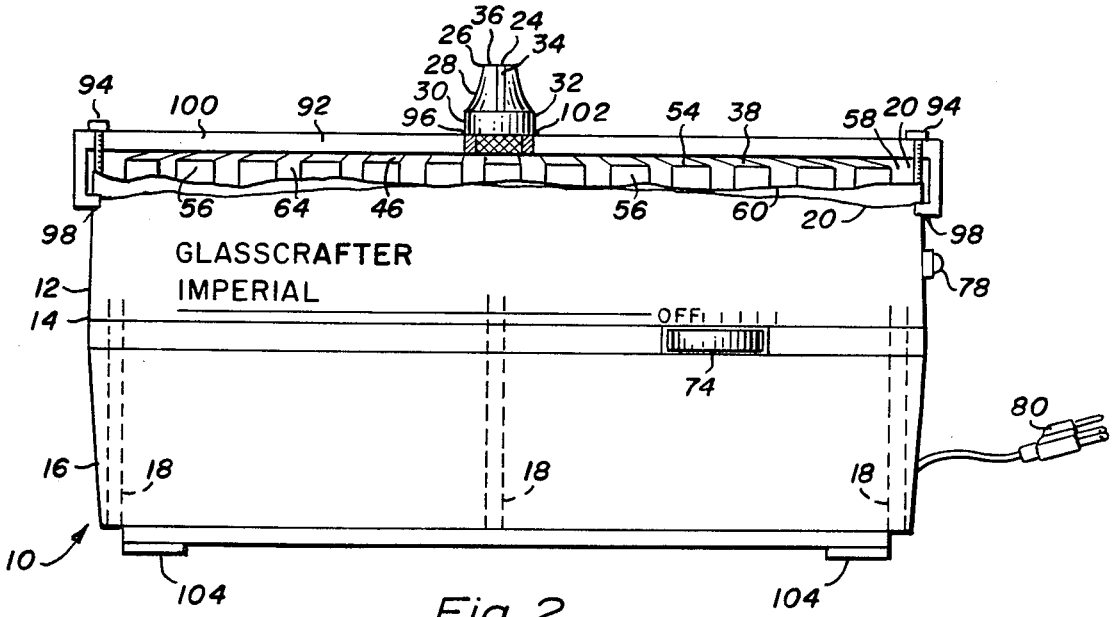
FIG. 2 is a frontal elevational view of the glass shaping machine of FIG. 1.

In FIG. 1, there is illustrated a glass shaping machine referred to by the general reference numeral 10 and incorporating the present invention. The glass shaping machine 10 includes a housing 12, a top portion 14, a bottom portion 16 and a set of threaded screw receptacles 18 (as shown in FIG. 2). The top portion 14 includes sloping horizontal member 20 with an offset center penetration 22, a driving shaft 24 and a grinding support head 26. Grinding support head 26 includes an externally tapered upper circular section 28, a base cylindrical section 30 and a grinding surface 32. The grinding support head 26 further includes a set of symmetrically spaced slots 34 and a tapered vertical hollow 36. The sloping horizontal member 20 includes an integral work surface 38 comprised of a first partial arcuate channel 40, a first partial ring of wedge-shaped segments 42, a second partial arcuate channel 44 and a second partial ring of wedge-shaped segments 46. The second partial arcuate channel 44 includes a set of terminal ends 48 and is blocked by a set of common wedge-shaped segments 50.

Additionally, each wedge-shaped segment 42 and 46 includes a narrow edge 52, a broad edge 54 and a flush outer surface 56 forming a continuous outer channel 58 with a peripheral vertical wall 60. Between each segment of the first partial ring of wedge-shaped segments 42 is a first set of grooves 62 and between each segment of the second partial ring of wedge-shaped segments 46 is a second set of grooves 64. Located on the sloping horizontal member 20 and between the set of common wedge-shaped segments 50 is a water lubrication absorption area 66 and a set of absorption medium upright supports 68. Also, penetrating housing 12 is a rotatable thumbwheel 74, a rocker switch 78, and an electrical cord cap 80.

Referring to FIG. 1, the glass shaping machine 10 is enclosed within the housing 12 comprised of the top portion 14 and bottom portion 16 which are physically connected together by screws inserted in the set of threaded receptacles 18 as shown in FIG. 2. The top portion 14 includes the sloping horizontal member 20 which forms a base in which offset center penetration 22 is provided. Protruding through offset center penetration 22 is the driving shaft 24 which is connected to a variable-speed driving motor 116 (shown in FIG. 3). Compressed about driving shaft 24 is grinding support head 26 which is comprised of a synthetic plastic including base cylindrical section 30 and externally tapered upper circular section 28. The grinding support head 26 is formed to receive the driving shaft 24 within tapered vertical hollow 36 which extends throughout the vertical dimension of the support head 26. Also, symmetrically spaced slots 34 penetrate the upper circular section 28 into the tapered vertical hollow 36 which permits compressively attaching the support head 26 to the driving shaft 24. The plastic support head 26 is unique because it is used to prevent seizing of the support head 26 to the driving shaft 24. This is accomplished by avoiding the use of brass, stainless steel or other metal configuration as the grinding support head. After grinding is initiated, a silica residue powder combines with the cooling water to form a slurry that hardens as it sets. The slurry has a tendency to harden as cement hardens when the slurry works its way between the driving shaft 24 and any metallic grinding support head 26. However, by using plastic, the slurry and other corrosion problems are eliminated. Additionally, because the plastic grinding support head 26 is tapered on the outside and inside, three equally-spaced slots 34 in the upper circular section 28 relieve this taper and act as a compressive member requiring no setscrew. The driving shaft 24 includes a flat side which will mate with a flat side located between two of the three slots 34 to assist locking the support head 26 housing onto the flat of the motor shaft 24. The grinding support head 26 may also be locked to the motor shaft 24 by using any number of spaced slots 34 or by a design utilizing small ribs within the grinding support head 26 that displace from elastic properties of the material of the support head 26. The grinding head 26 is also vertically adjustable on the drive shaft 24. The grinding surface 32 is comprised of soft iron, fillers and diamonds heat-fused together by powdered metallurgy or is comprised of a metal ring with plated nickel acting as a binder to hold diamonds in place. The grinding surface 32 is permanently affixed to the base cylindrical section 30 of the support head 26.

The integral work surface 38 is form molded directly as part of the top portion sloping horizontal member 20. Partially encircling the offset center penetration 22 is the first partial arcuate channel 40 uniformly located between penetration 22 and the first partial ring of wedge-shaped segments 42 rising above and also partially circumscribing penetration 22. The first partial arcuate channel 40 is located at the base of grinding surface 32 and is used to carry cooling water to reduce the friction of the glass being edged and to carry the previously described slurry away from the grinding area 32. The first partial ring of wedge-shaped segments 42 are concentric within the second partial ring of wedge-shaped segments 46. However, note that the segments of each partial ring 42 and 46 are not congruent with one another. The first partial ring 42 is uniformly separated from the second partial ring 46 by the second partial arcuate channel 44. The path of the second partial arcuate channel 44 coincides with that of the first partial arcuate channel 40 and has terminal ends 48 located at the point where channel 44 is interrupted by the common wedge-shaped segments 50. Wedge-shaped segments 50 are common to and larger than the wedge-shaped segments of the first and second partial rings 42, 46 and act to terminate the circumference of the second partial arcuate channel 44. Each wedge-shaped segment narrow edge 52 points radially towards penetration 22. The broad edge 54 of the first partial ring of wedge-shaped segments 42 extend radially from penetration 22, each terminating in flush vertical outer surface 56. It should be noted that the wedge-shaped-segments of the first partial ring 42 and the first set of grooves 62 formed between adjacent segments are in close proximity to provide added support to a glass being shaped and additional escape paths for the slurry residue. The increased number of smaller wedges 42 increases the work surface near the grinding support head 26 and provides for optimum water-slurry movement. Also, the plastic integral work surface 38 will aid in avoiding scratching of the glass being edged because the geometric radian design precludes rough textured glass from catching in slots of a prescribed increment pattern such as a square or parallel configuration. The broad edges 54 of the second partial ring of wedge-shaped segments 46 extend radially from the second arcuate channel 44 terminating in flush vertical outer surfaces 56 forming the continuous outer channel 58 with the peripheral vertical wall 60 of the top portion 14 of the housing 12. Also note that the first set of grooves 62 is formed between each adjacent segment of the first partial ring 42 and the second set of grooves 64 is formed between each adjacent segment of the second partial ring 46. Note that each alternate groove 64 formed between the second partial ring of wedge-shaped segments 46 aligns with each corresponding groove 62 formed between the first partial ring of wedge-shaped segments 42 to provide a broader work surface 38 and 60 promote the flow of slurry away from the grinding support head 26. The base of each groove of the first set of grooves 62 and the second set of grooves 64 is the sloping horizontal member 20 of the top portion 14. An important design feature is the slope from the offset center penetration 22 to the peripheral vertical wall 60. The sloping horizontal member 20 serves to promote the gravity flow of slurry from the first partial arcuate channel 40 to the continuous outer channel 58. The sloping horizontal member 20 is better illustrated in FIGS. 2, 5 and 7. Also, note that the grooves 64 formed between each segment of the second partial ring 46 lead into the continuous outer channel 58. The continuous outer channel 58 forms part of the reservoir that contains cooling water for the grinding surface 32. The channel 58 leads into the water lubrication absorption area 66 which serves to provide water to the absorption medium (not shown) which is usually a porous sponge that is placed in absorption area 66 and held in place by the absorption medum upright supports 68. Finally, FIG. 1 illustrates the rotatable thumbwheel 74 which is the manual device used by the operator to physically control the voltage fed to the variable-speed motor 116. Additional explanation appears in FIG. 3. Also, the electrical cord cap 80 provides the connection from the alternating voltage source (shown symbolically in FIG. 4) to the electrical circuitry within housing 12.

In FIG. 2, there is illustrated a frontal elevation of the glass shaping machine 10 of FIG. 1 depicting a planar fence 92, comprised of a pair of set screws 94, a vertical penetration 96, a pair of attachment lips 98, a rectangular straight edge 100 and a gap 102. Also, a set of base mounting supports 104 are shown. The base mounting supports 104 are comprised of a shock absorption material and are physically attached to the bottom of bottom portion 16. More specifically, planar fence 92 is illustrated in a frontal view in FIG. 2 and is temporarily secured to the top portion 14 by the pair of setscrews 94. The pair of attachment lips 98 mate with the corresponding groove within the body of the housing top portion 14. As the setscrews 94 are advanced to a securing position, the pressure between the planar fence 92 and the attachment lips 98 increase securing the planar fence position. The uniform rectangular straight edge 100 forms the upper portion of the planar fence 92 and includes the vertical penetration 96 for mating with the grinding support head 26 connected to the driving shaft 24. The setscrew attachment lips 98 are located at both ends of the long dimension of the rectangular straight edge 100. The vertical penetration 96 is centered respecting the long dimension and offset respecting the short dimension of the rectangular straight edge 100. Note that the long dimension of the straight edge 100 adjacent the vertical penetration 96 includes the gap 102 which permits access to and parallel edging of glass along the grinding surface 32 affixed to the grinding support head 26. The planar fence 92 can also be positioned in front of the grinding surface 32 spaced at predetermined increments and used as a straight edge guide. The planar fence 92 is adjustable for various widths of glass and is used to finish parallel edges.

Figure 3:
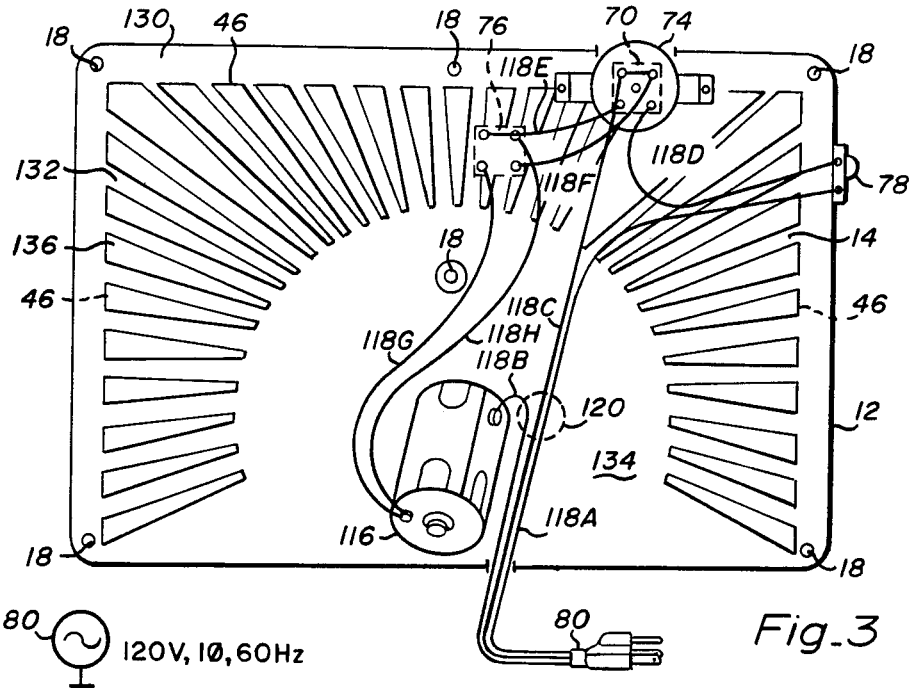
FIG. 3 is a bottom view of the top portion of the glass shaping machine of FIG. 1.
Figure 4:
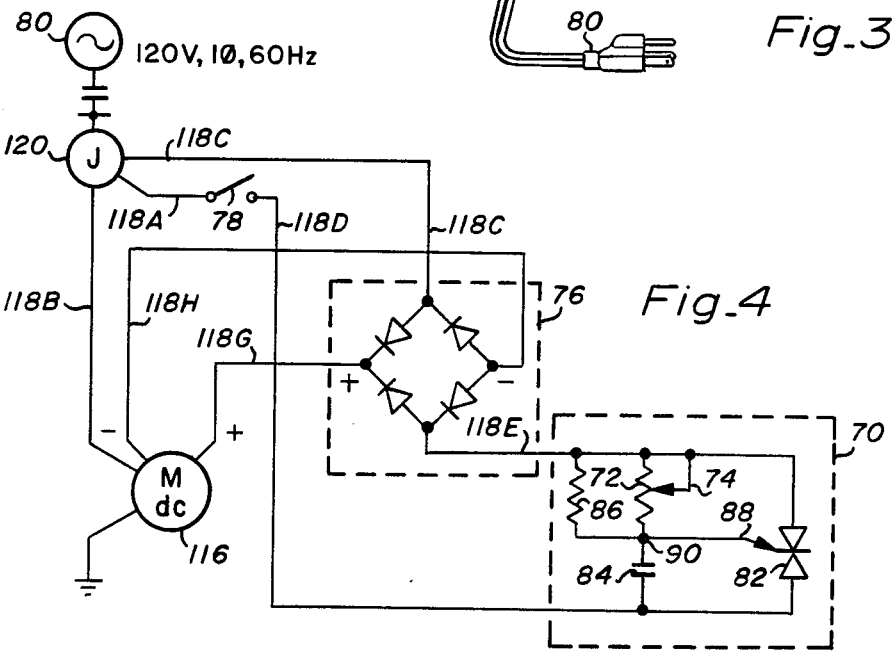
FIG. 4 is a circuit diagram of the glass shaping machine of FIG. 1.

FIG. 3 illustrates a bottom view of the top portion 14 of housing 12. Also shown are threaded screw receptacles 18, a bottom view of the second partial ring of wedge-shaped segments 42, controller 70, rotatable thumbwheel 74, a full-wave bridge rectifier 76, rocker switch 78, electric cord plug 80, variable-speed driving motor 116, and a set of associated wires 118 (A, B, C, D, E, F, G and H) with a junction connection 120. Also shown is a general interior area 130 comprised of an interior outer area 132 and an interior inner area 134 and a series of interior outer area depressions 136. FIG. 3. discloses the electrical circuitry associated with the glass-shaping machine 10, the circuit diagram of which is shown in FIG. 4. In FIG. 3 the threaded screw receptacles 18 are distributed about the top portion 14 of housing 12. The interior area 130 is divided into two general areas. The outer area 132 is the bottom surface of the second partial ring of wedge-shaped segments 46. Since the wedge-shaped segments of the second partial ring 46 rise above the offset center penetration 22, as shown in FIG. 1, the bottom view of the outer area 132 discloses the molded wedge-shaped segments 46 as depressions 136 extending below bottom surface of a portion of the second partial ring of wedge-shaped segments 46 and the first partial ring of wedge-shaped segments 42 as shown in FIG. 1.

The electrical circuit is connected to the alternating voltage supply by the cord plug 80 of FIG. 3. The supply is shown as the 120 volt, single phase, 60 Hertz supply in FIG. 4 but the glass shaping machine 10 is also available in a 240 volt, 50 Hertz edition for export. FIG.

4 further includes a speed control variable resistor 72, a triac 82, a charging capacitor 84, a linearization resistor 86, a triac pulse trigger 88, and a junction point 90. The cord plug includes three wires, the phase conductor 118A, the ground conductor 118B and a neutral 118C. As the cord plug 80 enters the housing top portion 14 the wires 118A, 118B and 118C are separated at point 120 and this is illustrated in FIG. 4 by use of the junction box symbol 120. Ground conductor 118B is securely fastened to a chassis nut on motor 116 in FIG. 3 and to the motor ground symbol 116 in FIG. 4. Phase conductor 118A connects to the A.C. line at junction box 120 and to the input terminal of rocker switch 78. The output terminal of switch 78 is connected to conductor 118D which is a switched conductor, switched conductor 118D is connected to an A.C. input terminal of the controller 70. The neutral conductor 118C is also connected to the A.C. line at junction box 120 and a first A.C. line terminal of the full-wave rectifier bridge 76. A second A.C. line terminal of the bridge 76 is connected to a load terminal of controller 70 via conductor 118E. Full-wave rectifier bridge 76 is connected to the variable speed driving motor 116 at a pair of D.C. load terminals on bridge 76 via conductors 118G and 118H. The full-wave bridge rectifier 76 is a sealed unit and provides full-wave rectification of the A.C. input wave form. Although the controller 70 is capable of providing half-wave rectification, the full-wave rectifier bridge 76 provides a higher average value of direct current and reduces heating of motor 116. Conductors 118G and 118H are connected to the rotor winding of motor 116 which is a direct current permanent magnet variable speed motor. The output speed of motor 116 is dependent upon the D.C. input signal to the rotor windings. The field excitation of motor 116 is fixed by using permanent magnets on the pole pieces. As the rotatable thumbwheel 74 is rotated by a user, the speed of motor 116 is varied causing the speed of driving shaft 24, grinding support head 26 and the grinding surface 32 to vary. The variable speed feature offers the user a previously unavailable control of the edging speed used which is very useful in working with different types of glass.

Note that FIG. 4 shows the A.C. neutral conductor 118C connected directly to bridge 76 with conductor 118E interconnecting bridge 76 and controller 70. Referring to FIG. 3, the A.C. neutral conductor 118C is shown connected between cord plug 80 and the A.C. line terminal of controller 70. The neutral conductor 118C is shown in the schematic diagram of FIG. 4 as connected directly to bridge 76 for illustration purposes only. The neutral conductor 118C is actually connected to the A.C. line side of controller 70, however, that A.C. line side is short circuited to the load side of the controller 70 and then connected directly to the A.C. line side of rectifier 76 as is shown in FIG. 3. Thus, FIG. 4 eliminates the shorted terminals within controller 70 and shows the neutral conductor 118C connected directly to rectifier 76.

The controller 70 includes the rotatable thumbwheel 74 electrically connected to the speed control variable resistor 72. The thumbwheel 74 is shown as a wiper connection such that as the thumbwheel 74 is rotated, the wiper arm changes position upon the variable resistor 72. The charging capacitor 84 is in series with variable resistor 72 forming an RC circuit. Linearization resistor 86 is in parallel with variable resistor 72 and the triac pulse trigger 88 is connected between the junction point 90 and the triac 82. The RC circuit formed by variable resistor 72 and capacitor 84 is the mechanism that controls the "on-off" status of the triac 82. The charging rate or rise time of capacitor 84 is controlled in part by the size of the resistance of variable resistor 72. It is the charge across capacitor 84 that controls the firing point of triac 82. Variable resistor 72 is actually a potentiometer and as thumbwheel 74 is rotated, the resistance of variable resistor 72 varies 20K ohms to 230K ohms. Since capacitor 84 is fixed in size, the rise time of capacitor 84 is controlled by variable resistor 72. The rise time is the time interval between the response time to 10% steady state value and the response time to 90% steady state value of the capacitor 84 fully charged. If capacitor 84 is not charged then triac 82 is "off" and act as an open circuit. If thumbwheel 74 is rotated in the direction to cause variable resistor 72 to become large, then the rise time of capacitor 84 is large and triac 82 does not turn on until capacitor 84 has a sufficient charge. When the thumbwheel 74 is rotated to cause variable resistor 72 to be small, the rise time is reduced. The capacitor 84 then discharges into the triac pulse trigger 88 from function point 90 more often. The triac 82 is a semiconductor device that includes the pulse trigger 88 which is a sensitive gatebed. If the charge on capacitor 84 is sufficiently high, the pulse trigger 88 is pulsed when capacitor 84 discharges. The triac 82 then is "on" and acts like a short circuit. The voltage to the motor 116 is controlled by the timing sequence of the discharging of capacitor 84 into pulse trigger 88. By advancing or retarding the timing sequence, the "on-off" point of the triac 82 is varied providing a full positive half cycle or any partial position half cycle.

The variable resistor 72 is non linear, as are many potentiometers, because most of the voltage drop in the potentiometer occurs at one end of the winding due to characteristics inherent in construction. By connecting the linearization resistor 86 in parallel with variable resistor 72, the travel of the variable resistor 72 is made more linear. The variable resistance 72 is a resistive-inductive device with a leading phase angle. By adding linearization resistor 86 in parallel with variable resistor 72, the parallel combination abuses the voltage drop across the combination to be more linear with the respect to the position of thumbwheel 74 because of a phase angle change in the A.C. waveform.

Figure 5:
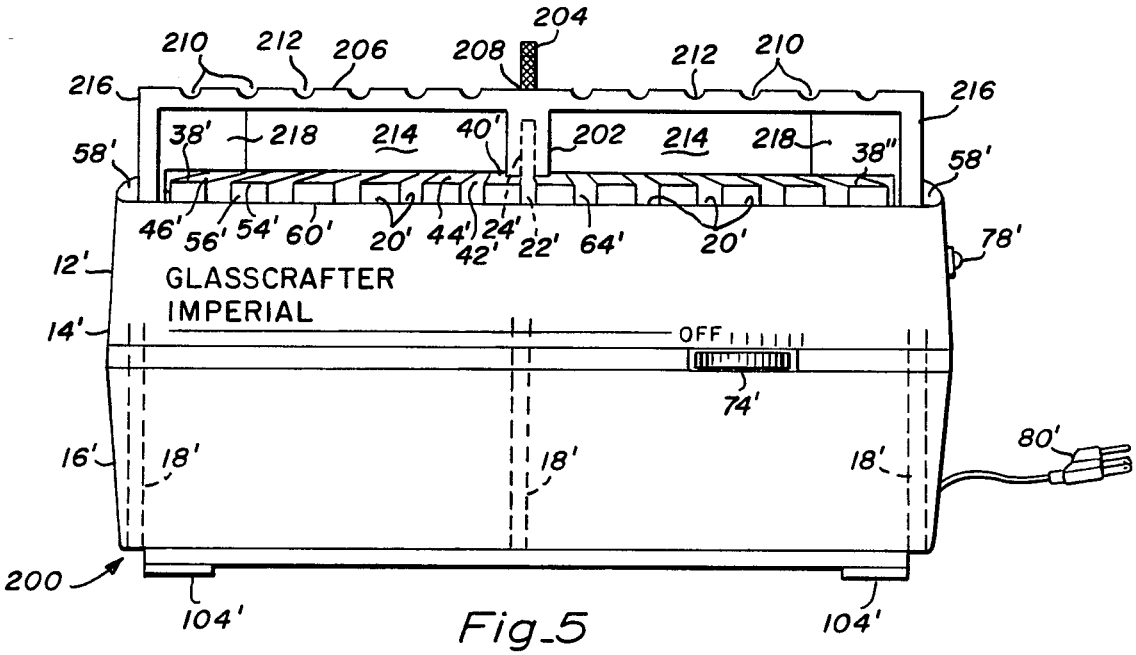
FIG. 5 is a frontal elevation view of a first alternative embodiment of the glass shaping machine of the present invention.

FIG. 5 illustrates a high speed rotary grinder which is a first alternative embodiment of the glass shaping machine and referred to by the general reference numeral 200. Those elements of the machine 200 common to the machine 10 carry the same reference numeral distinguished by a prime designator. The high speed rotary grinder 200 includes a housing 12' comprised of a top portion 14', a bottom portion 16' and a set of threaded screw receptacles 18'. The top portion 14' includes a sloping horizontal member 20' including an offset center penetration 22'. A driving shaft 24' protrudes through penetration 22' and connected to the driving shaft 24' is a first auxiliary connection fitting 202 and a diamond plated round rasp 204. The sloping horizontal member 20' includes an integral work surface 38' comprised of a first partial arcuate channel 40', a first partial ring of wedge-shaped segments 42' and a second partial arcuate channel 44', each as shown in FIG. 1. Also included is a second partial ring of wedge-shaped segments 46' and a set of terminal ends 48' each blocked by a common wedge-shaped segment 50' as shown in FIG.

1. Each wedge-shaped segment 42' and 46' includes a narrow edge 52' (shown in FIG. 1) and a broad edge 54' with a flush outer surface 56' forming a continuous outer channel 58' with a peripheral vertical wall 60'. Between each segment of the first partial ring of wedge-shaped segments 42' is a first set of grooves 62' (as shown in FIG. 1) and between each segment of the second partial ring of wedge-shaped segments 46' is a second set of grooves 64'. Penetrating the housing 12' is a rotatable thumbwheel 74', a rocker switch 78', an electrical cord cap 80' and a set of base mounting supports 104'. The embodiment 200 of FIG. 5 also includes an auxiliary work surface 206 with an auxiliary penetration 208. The auxiliary work surface 206 is flat and may be aluminum, plastic or synthetic resin and comprises a simple radian or square grid configuration of grooves 210. A plurality of drain holes 212 are provided in the grooves 210. Further, the auxiliary work surface 206 includes a stability mounting web 214 attached to a frame 216 including a plurality of locking ribs 218.

The operation of the high speed rotary grinder 200 is very similar to the glass shaping machine 10 except that the grinding occurs on the auxiliary work surface 206. The high speed rotary grinder 200 acts as a miniature rotary grinder and is used for rotary sawing flat glass guided on the auxiliary work surface 206 by manual operation. The grinder 200 is comprised of the diamond plated round rasp 204 connected to the motor driving shaft 24' by the first auxiliary connection fitting 202. The round rasp 204 protrudes through the auxiliary penetration 208. The auxiliary work surface 206 mounts directly onto the integral work surface 38' and the auxiliary work surface 206 is flush with the first auxiliary connection fitting 202. FIG. 5 illustrates an elevation of the auxiliary work surface 206 with the radian configuration of grooves 210. Note that frame 216 of auxiliary work surface 206 mounts within the continuous outer channel 58'. The slurry that is formed on the auxiliary work surface 206 will flow into the grooves 210 whether the configuration is radian or square grid. The grooves 210 in the simple radian configuration radiate from the auxiliary penetration 208. The grooves 210 in the square grid configuration form the grid pattern about the auxiliary penetration 208. The drain holes 212 are placed within the grooves 210 and a portion of the slurry flowing in the grooves 210 will drain down onto the integral work surface 38' and into the first set of grooves 62' and the second set of grooves 64'. The slurry falling onto the integral work surface 38' flows to the continuous outer channel 58'. The remaining portion of the slurry on the auxiliary work surface 206 flows out the end of the grooves 210 and down into the continuous outer channel 58'. Connected to the frame 216 and to the bottom of the auxiliary work surface 206 is the stability mounting web 214 comprised of three locking ribs 218. Each locking rib 218 is orthogonal to the bottom side of the auxiliary work surface 206 and lateral to each of the other locking rib 218. The purpose of the locking ribs 218 is to keep the auxiliary work surface 206 stable during use. The locking ribs 218 seat in the first set of grooves 62' and the second set of grooves 64' on the sloping horizontal member 20'. Thus, the locking ribs 218 are blocked from moving by the first partial ring of wedge shaped segments 42' and the second partial ring of wedge shaped segments 46'. It should be noted that the variable speed driving motor 116 permits the rotary grinder 200 to saw flat glass at ten-thousand RPM. This speed capability enables the user to rotary saw any flat glass and add additional life to the diamond plated round rasp 204.

Figure 6:
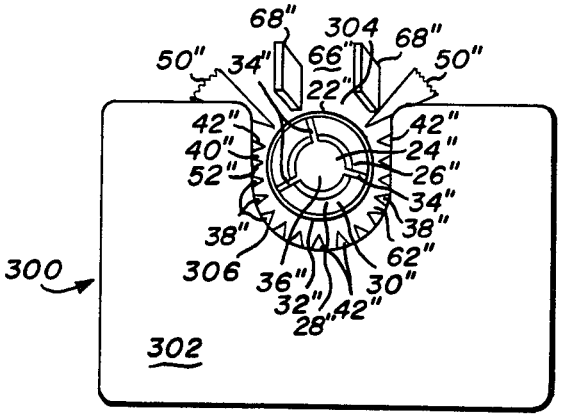
FIG. 6 is a plan view of a second alternative embodiment of the glass shaping machine of the present invention.

FIG. 6 illustrates a second alternative embodiment of the glass shaping machine and referred to by the general reference numeral 300. Those elements of the machine 300 common to the machine 10 carry the same reference numeral distinguished by a double prime designation. The second alternative embodiment 300 of FIG. 6 also includes a removable platform 302, a platform opening 304, and a platform round section 306.

The embodiment 300 permits the preferred embodiment 10 to be adapted for shaping small glass objects. When small glass objects are placed upon the integral work surface 38'', they become blocked by or fall between the segments of the first partial ring of wedge shaped segments 42'' and become trapped within the first set of grooves 62''. The removable platform 302 is positioned on that portion of the integral work surface 38'' that is supported by the first partial ring of wedge-shaped segments 42''. The platform opening 304 fits about the grinding surface 32'' of the grinding support head 26'' and is shown exposed for illustration purposes. The platform round section 306 is supported by the first partial ring of wedge shaped segments 42''. A glass object too small to be supported by the integral work surface 38'' is placed upon the removable platform 302 and may be hand-guided and shaped without falling into the first set of grooves 62''. The removable platform 302 may also be used with the auxiliary work surface 206 of embodiment 200. The platform round section 306 rests upon the auxiliary work surface 206 and the platform opening 304 fits about the diamond plated round rasp 204. The slurry created by shaping the small glass object is disposed of as described in preferred embodiment 10 and alternative embodiment 200.

Figure 7:
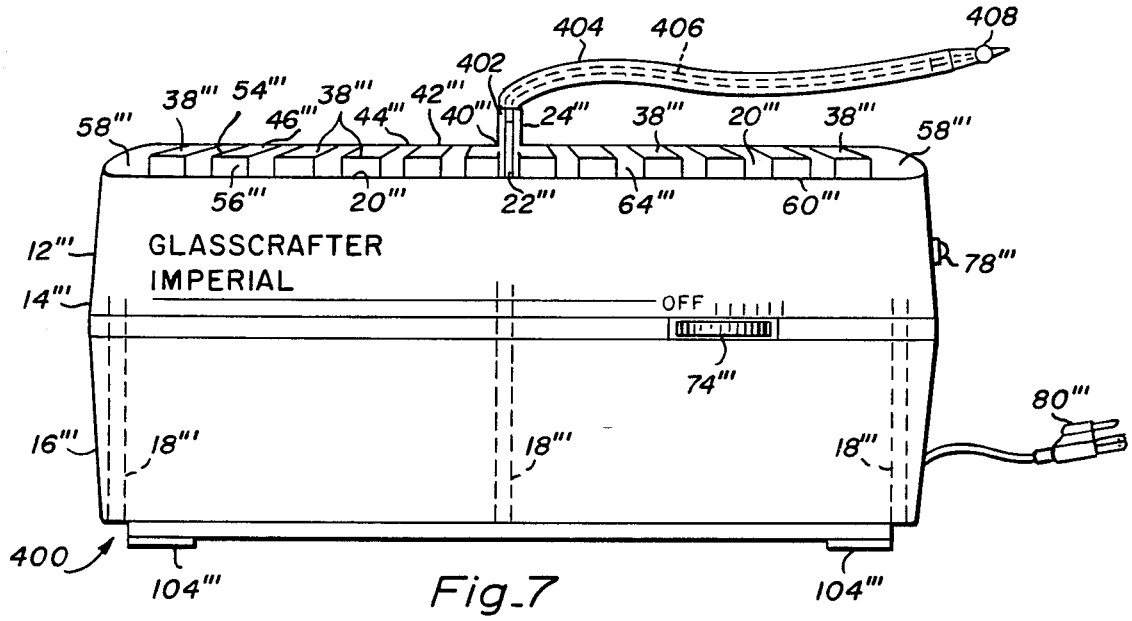
FIG. 7 is a frontal elevation view of a third alternative embodiment of the glass shaping machine of the present invention.

FIG. 7 refers to a third alternative embodiment of the present invention and referred to by the general reference character 400. FIG. 6 includes each element enumerated in the grinder 200 except the first auxiliary connection fitting 202, rasp 204, auxiliary work surface 206, auxiliary penetration 208 and elements 210, 212, 214, 216 and 218 associated with the auxiliary work surface 206. Those elements of the machine 400 common to the machine 200 carry the same reference numeral distinguished by a triple prime designation. The grinder 400 further includes a second auxiliary connection fitting 402, a flexible shaft 404, a cable 406 and a ball-shaped or other diamond burr 408.

The high-speed rotary machine 400 is comprised of a flexible cable 406 that is directly connected to the motor driving shaft 24''' by the second auxiliary connection fitting 402. The cable 406 rotates within the flexible shaft 404 causing the diamond burr 408 to rotate at the speed of motor 116'''. The diamond burr 408, which may also be cone shaped, pointed, or cylindrical, is utilized for engraving. The ten thousand RPM variable-speed driving motor 116''' permits the user to engrave more efficiently. Small diameter diamond tools operating at the low RPM $\mu$:3000 are ineffective due to the surface speed of the grinding medium. Diamonds grinding mediums are more suited to the higher RPM, are more efficient in cutting, and last longer.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

We claim:

1. A glass shaping machine comprising, in combination:

a housing means having a top portion supporting a sloping horizontal member with an offset center penetration through said sloping horizontal member, a bottom portion, and a means for connecting said top portion to said bottom portion;

a work surface integrally formed to said sloping horizontal member for supporting a glass being shaped wherein the integral work surface includes a first partial ring of wedge-shaped segments rising above and partially circumscribing said offset center penetration, a first partial arcuate channel uniformly separating said first partial ring from said offset center penetration, said first partial ring being concentric within and non-congruent with a second partial ring of wedge-shaped segments, said first partial ring uniformly separated from said second partial ring by a second partial arcuate channel described by a circular path with a set of terminal ends, said second partial arcuate channel interrupted at each of said terminal ends by a wedge-shaped segment common to each of said first and said second partial rings, said wedge-shaped segments comprised of a narrow edge and a broad edge, said broad edge terminating in a flush vertical outer surface; said broad edges of said first partial ring of wedge-shaped segments extending radially from said offset center penetration and said broad edges of said second partial ring of wedge-shaped segments extending radially from said second arcuate channel, said flush vertical outer surfaces of said second partial ring of wedge-shaped segments forming a continuous outer channel with a peripheral vertical wall of said top portion of the housing means and further including a groove formed between each adjacent segment of said first and second partial rings and wherein each alternate groove formed between the second partial ring aligns with each corresponding groove formed between said first partial ring and wherein said grooves formed between each segment of said second partial ring lead into said continuous outer channel;

a driving means for rotating a driving shaft protruding through said offset center penetration, the driving means having a variable speed capability and mounted within the housing means;

a grinding support head located external to the housing means above the integral work surface and in mechanical communication with said driving shaft;

a grinding surface shaped to fit and permanently affixed to the grinding support head for finishing and shaping a plurality of glass surfaces;

a speed control means for providing a variable voltage input to the driving means, said speed control means mounted within the housing means; and a rectifying means for translating an alternative current signal to a variable direct current signal and transmitting said variable direct current signal to the driving means, said rectifying means mounted within the housing means.

2. The glass shaping machine of claim 1 wherein said segments of said first partial ring and said grooves formed between adjacent segments are in close proximity to provide added support to a glass being shaped and wherein said sloping horizontal member being sloped from said first partial arcuate channel to said continuous outer channel, said first partial arcuate channel being at a higher vertical elevation than said continuous outer channel for providing optimum migration of a residue away from said offset center penetration.

3. The glass shaping machine of claim 1 wherein the grinding surface is a high speed rotary grinder for sawing flat glass comprised of a diamond-plated round rasp and further including an auxiliary work surface including an auxiliary penetration for mating with said round rasp, said auxiliary work surface mounted on the integral work surface and flush with said grinding support head and wherein said auxiliary surface being flat and having a radian configuration of grooves radiating from said auxiliary penetration, said radian configuration of grooves having a plurality of drain holes for draining a first portion of a residue flowing in said radian configuration of grooves to said first set and said second set of grooves of the integral work surface, said auxiliary work surface having a frame mounted in said continuous outer channel and said radian configuration of grooves directing a second portion of said residue to said continuous outer channel for providing migration of said residue away from said auxiliary penetration.

4. The glass shaping machine of claim 1 wherein the grinding surface is a high speed rotary grinder for sawing flat glass comprised of a diamond-plated round rasp and further including an auxiliary work surface including an auxiliary penetration for mating with said round rasp, said auxiliary work surface mounted on the integral work surface and flush with said grinding support head and wherein said auxiliary work surface being flat and having a square grid configuration of grooves about said auxiliary penetration, said square grid configuration of grooves having a plurality of drain holes for draining a first portion of a residue flowing in said square grid configuration of grooves to said first set and said second set of grooves of the integral work surface, said auxiliary work surface having a frame mounted in said continuous outer channel and said square grid configuration of grooves directing a second portion of said residue to said continuous outer channel and wherein said frame of the auxiliary work surface further includes a stability mounting web for stabilizing said auxiliary work surface while sawing flat glass.

5. The glass shaping machine of claim 3 further including a stability mounting web connected to the frame and to a bottom of said auxiliary work surface and comprised of a plurality of locking ribs, said locking ribs being mutually orthogonal with said bottom of said auxiliary work surface and each adjacent locking rib, said locking ribs being seated within said first set and said second set of grooves between said first and said second partial ring of wedge shaped segments blocking the movement of said plurality of locking ribs for stabilizing said auxiliary work surface while sawing flat glass.

6. The glass shaping machine of claim 3 wherein said auxiliary work surface being further adapted for processing small pieces of glass further including a removable platform in mechanical communication with said auxiliary work surface for shaping small glass objects and a platform opening for mounting said removable platform about said high speed rotary grinder.

7. The glass shaping machine of claim 1, further including a removable platform means in mechanical communication with said integral work surface for shaping small glass objects and a platform opening for mounting said removable platform means about the grinding surface, said removable platform being supported by said first partial ring of wedge-shaped segments.

* * * * *